US007475690B2

(12) United States Patent
Cho

(10) Patent No.: US 7,475,690 B2
(45) Date of Patent: Jan. 13, 2009

(54) MECHANICAL EYELASH CURLER

(76) Inventor: Yong Hoon Cho, 604 Murfield Ct., Fullerton, CA (US) 92835

( * ) Notice: Subject to any disclaimer, the term of this patent is extended or adjusted under 35 U.S.C. 154(b) by 10 days.

(21) Appl. No.: 11/438,505

(22) Filed: May 22, 2006

(65) Prior Publication Data

US 2007/0267036 A1 Nov. 22, 2007

(51) Int. Cl.
*A45D 2/48* (2006.01)

(52) U.S. Cl. ..... 132/217

(58) Field of Classification Search ..... 132/216–218; D28/35, 36
See application file for complete search history.

(56) References Cited

U.S. PATENT DOCUMENTS 3,654,939 A * 4/1972 Davidson ..... 132/216
5,524,649 A * 6/1996 Suh ..... 132/217
5,960,799 A * 10/1999 Suh ..... 132/217
2004/0020505 A1* 2/2004 Sugiyama ..... 132/217
2005/0061347 A1* 3/2005 Park ..... 132/217

* cited by examiner

*Primary Examiner*—Robyn Doan
*Assistant Examiner*—Rachel A Running
(74) *Attorney, Agent, or Firm*—Maria Erlinda Co Sarno

(57) ABSTRACT

An eyelash curler made of a polymeric material such as plastic or of a non-temperature conducting, light but sturdy and durable material comprising a head section and a body section. The head section includes a curling component having a back side and a front side where an eyelash to be curled is introduced. The curling component has a metal blade at its forming member to form better curls than a plastic blade. The lower end of the body section serves as the handle for the device. A push button controls the curling component and is situated at a position opposite the front side of the curling component thereby preventing the push button from contacting the face of a user.

19 Claims, 6 Drawing Sheets

MECHANICAL EYELASH CURLER

BACKGROUND

This invention relates to a manually operated eyelash curler with improved curling members and handle.

Manually operated eyelash curlers are currently made of one material, either made entirely of plastic or entirely of metal but not in combination with each other. Metal eyelash curlers offer better curling functions than plastic eyelash curlers because the metal blade, one pressing on the eyelashes against a pressurizing member, provides a stronger pressure on the eyelashes compared to a plastic blade. However, metals are good temperature conductors, taking on the temperature of its surrounding. This makes the eyelash curler at times initially too cold for the fingers and hands during the operation of the eyelash curler until it takes on the temperature of the user. Also, current metal eyelash curlers are inconvenient to use because the fingers have to situate into two openings for operation, much like those used in the operation of a scissors. For users with fingers larger than the openings, this may even result into formation of sores or blisters and for users with thin fingers, this results in more difficulty with controlling the eyelash curler.

It is therefore an object of this invention to provide an eyelash curler with a metal blade but plastic body.

It is also an object of this invention to provide an eyelash curler with a body ergonomically shaped for better grip and function.

It is a further object of this invention to situate the push button used for the operation of the eyelash curler away from the face of a user.

SUMMARY OF THE INVENTION

The invention relates to an eyelash curler, comprising a head section and a body section, the head section including a curling component comprising a forming member and a pressurizing member. The forming member has a metal blade and the pressurizing member has a pad situated on top of a push rod. The body section is formed from an upper case connecting to a lower case. The lower end of the body section also serves as the handle for the eyelash curler. There is a receiving base on a top end or head section of the upper case for holding the forming member. Means for engaging and disengaging the pressurizing member with the forming member are provided. In the example provided, the means for engaging and disengaging the pressuring member with the forming member is a push button inserted into a hole at the upper case of the eyelash curler at a direction facing opposite the front side of the curling component. The push button raises the push rod as the push button press a plate spring against the lower case of the body section when it engages the pressurizing member with the forming member. When the push button disengages the pressuring member from the forming member, it recesses the push rod by releasing the plate spring from pressing against the lower case of the body section. The plate spring is inserted into a channel located inside the push button. The metal blade is curved to conform with an eyelash line and the pad is shaped to match the metal blade. The pad is recommended to be made of silicone. The receiving base in the example shown is a forwardly curved extension on the head section of the upper case. The eyelash curler except for the forming member is usually made of a polymeric material or plastic. Instead of a polymeric material or plastic, a non-temperature conducting, light but sturdy and durable material can also be used. The forming member can also be made of a polymeric or a non-temperature conducting material so long as the blade is made of metal.

DETAILED DESCRIPTION OF THE INVENTION

Figure 1:
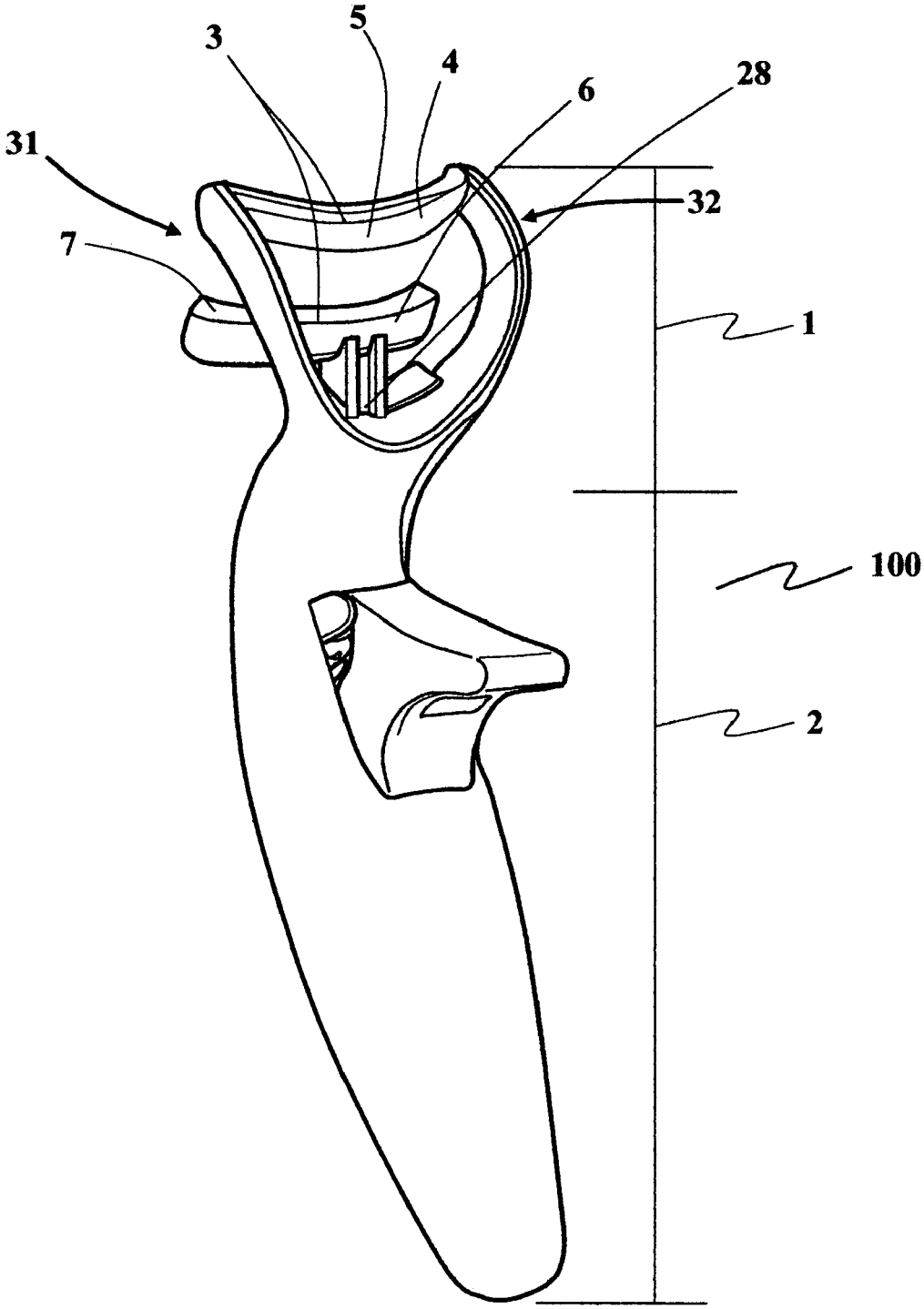
FIG. 1 is a perspective view of the eyelash curler.

The eyelash curler 100 of this invention comprises a head section 1 and a body section 2 as shown in FIG. 1. The lower end of the body section 2 also serves as the handle of the eyelash curler. The curling component 3 is situated at the head section 1 and comprises a stationary forming member 4 having a blade 5 and a moving pressurizing member 6 having a pad 7 usually made of silicone or other material with similar properties such as natural or synthetic rubber and its derivatives. In the claimed invention, only the forming member or only the blade of the forming member is made of metal. The rest of the parts are made of polymeric materials such as plastic or non-temperature conducting materials which are inexpensive and light but sturdy and durable. The forming member 4 as shown detached from the upper case 8 in FIG. 2, has a curved metal blade 5 conforming to the curvature of the eyelash line with each side of the blade 5 connecting or extending to a common continuous strip 9 which in this example is shown as circular in shape. The forming member 4 may be made entirely of metal or it can be made partly of plastic so long as the blade 5 is made of metal. The forming member 4 engages in a superimposing position to a matching receiving base 10 at the top end or the head section of the upper case 8 through the strip 9. The receiving base 10 is shaped to conform with the shape of the forming member, more specifically, the strip 9 which in this example is a forwardly circular extension. The strip and the receiving base can have a shape other than circular. The strip with the metal blade in the example shown here, slips and/or snaps on top of the receiving base and is held by the engagement of matching indentations 11 on the receiving base with the protrusions 12 on the strip 9. Other means of engagement like gluing with or without snapping the pieces together is an option. It is also possible to mold the metal blade, the strip and the receiving base together in one unit.

The eyelashes to be curled are pressed between the pad 7 situated on top of the pressurizing member 6 and the metal blade 5 of the forming member 4. The pressuring member 6 is a curved laterally extending part 13 of a push rod 14 whose rising and falling motion is controlled by a push button 15. The pad 7 at the pressurizing member is shaped to match the shape of the metal blade 5 at the forming member which conforms to the curvature of the eyelash line. The push button 15 is inserted into a hole 16 below the curling component at the upper case 8 of the body section 2 and faces a direction opposite the front side 31 of the curling component, that is, opposite the moving pressurizing member 6 as shown in FIG. 1. The push button 15 is situated at the same side as the stationary forming member 4 at the backside 32 of the curling component. This position will avoid the push button from hitting the face of the user while the eyelash curler is being used, thereby, not smearing any make up on the face of the user. Further, with the push button at this position one can easily grasp on the handle and use the fore and/or the middle finger to operate the push button.

Figure 3:
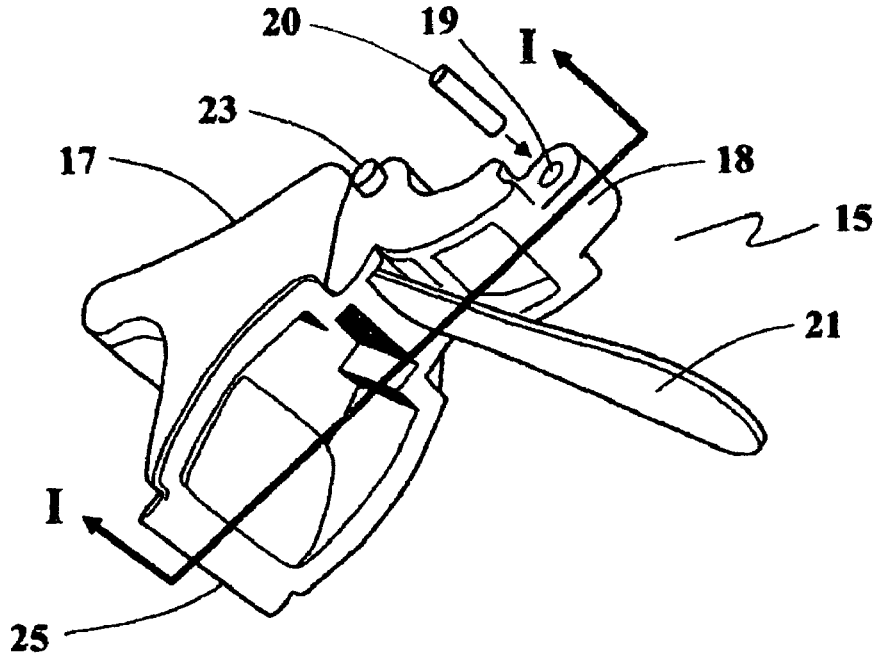
FIG. 3 is a perspective view of the push button.
Figure 3A:
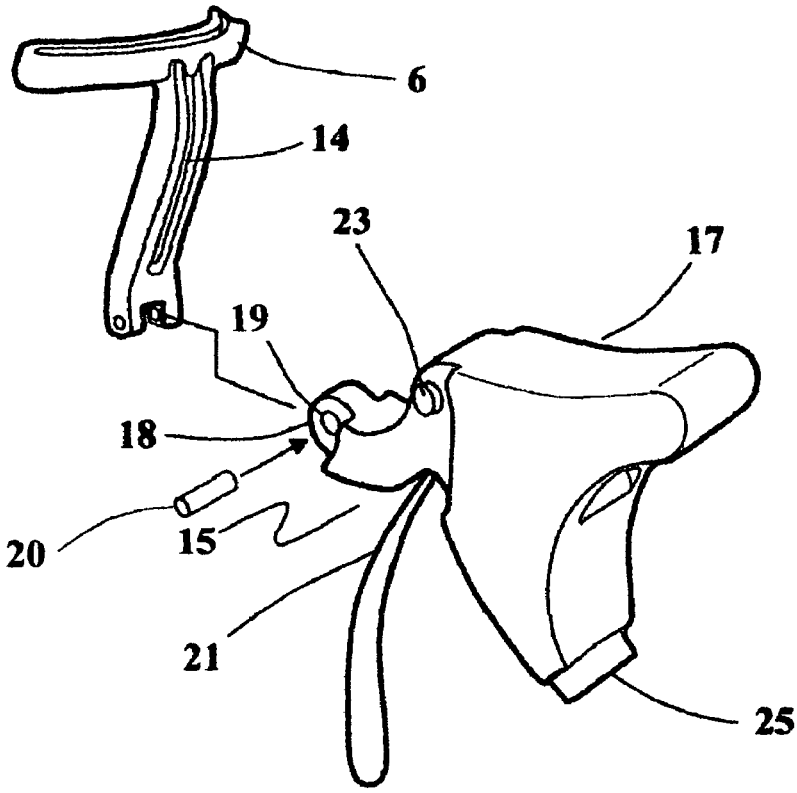
FIG. 3A is an exploded view showing how the push rod connects to the push button.
Figure 3B:
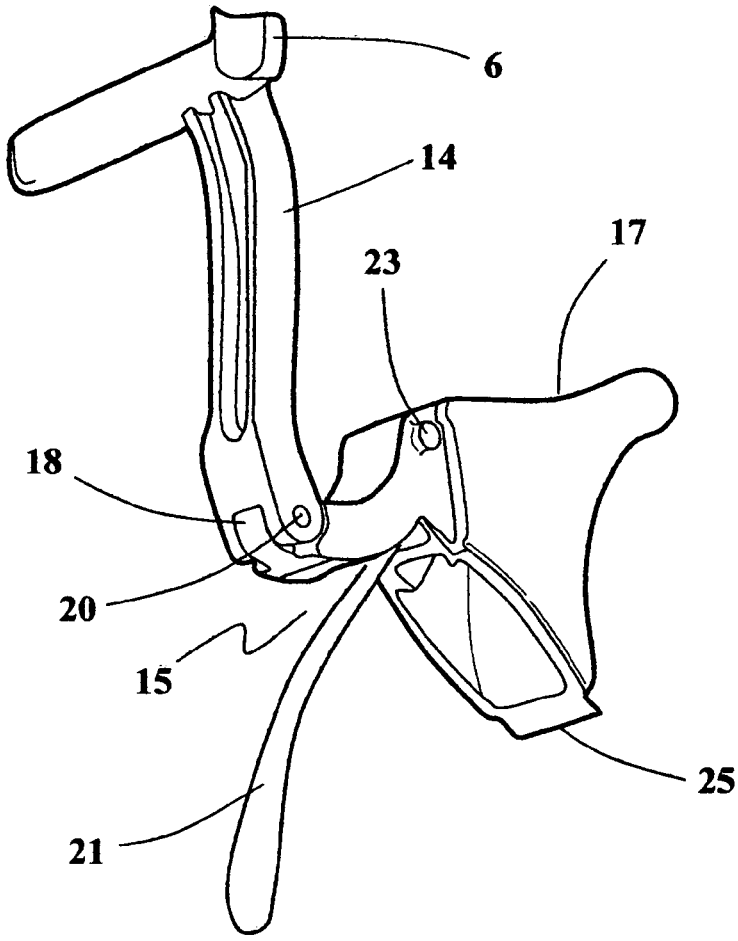
FIG. 3B is a perspective view of the push rod connected to the push button.

The push button 15 is shown in FIG. 3. The fingers press on the surface 17 of the push button 15 which is connected to the push rod 14 by means of a hinge connector 18 which is short protruding cylindrical rod with a central through opening 19 at one end of the push button. The push rod connects by a pin 20 inserted from one end of the push rod, through the central opening 19 and through the opposite end of the push rod as shown in FIGS. 3A and 3B. The push rod 14 is free to pivot around the hinge connector 18 after insertion of the pin 20. The rising and falling motion of the push rod is controlled herein through the use of a plate spring 21 rather than a coil spring which is currently used. The use of a plate spring provides advantages over the use of a coil spring. The plate spring reduces or eliminate the noise coming from the squeezing and releasing action of the coil during the operation of the eyelash curler and it requires less pressure than the coil to cause the push rod to rise or fall, thus resulting in better curling action. In a rising motion, the push rod is raised upwards towards the forming member while in a falling motion, the push rod recesses towards the interior of the body section.

Figure 2:
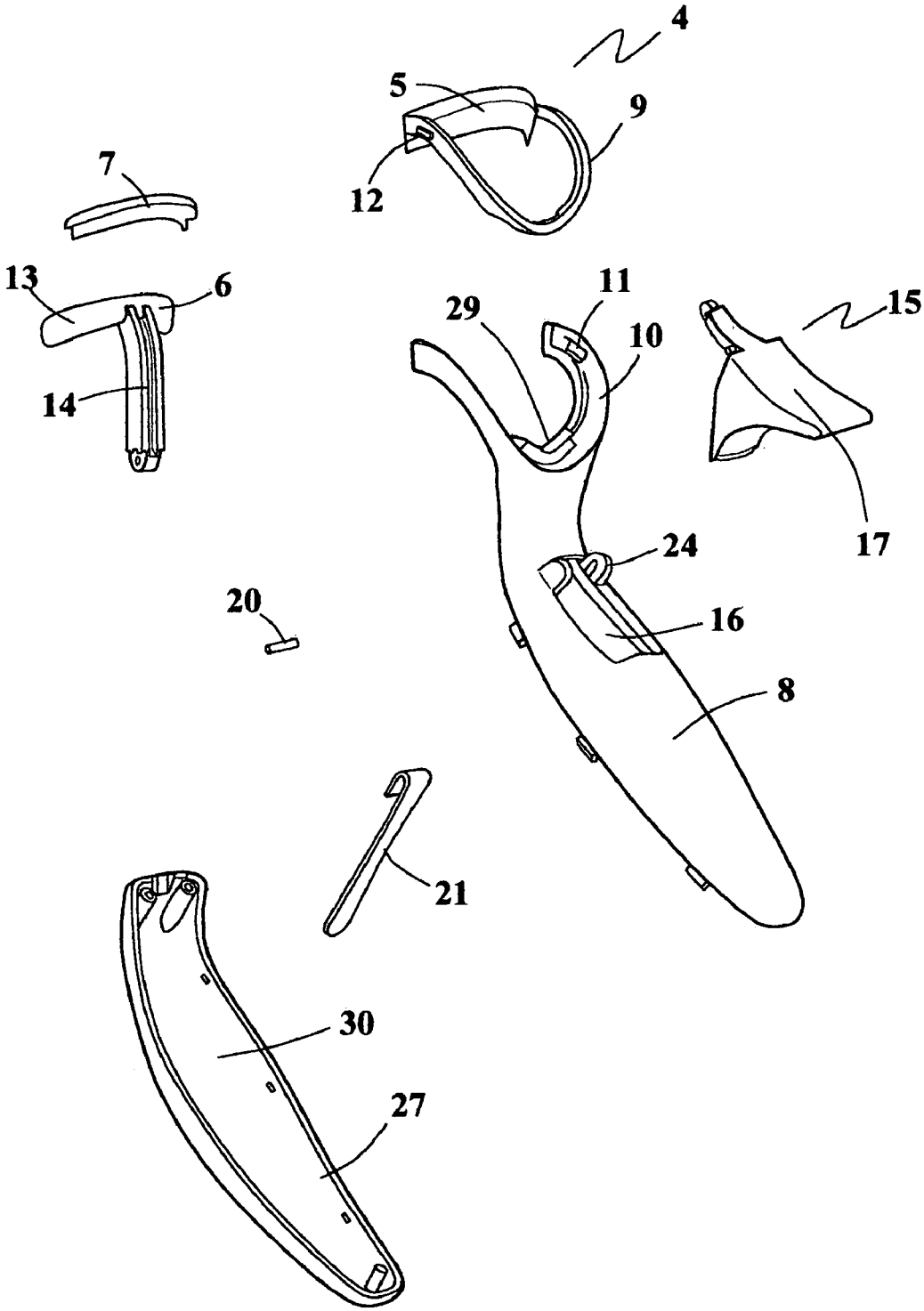
FIG. 2 shows the components of the example of the eyelash curler shown in FIG. 1.
Figure 4:
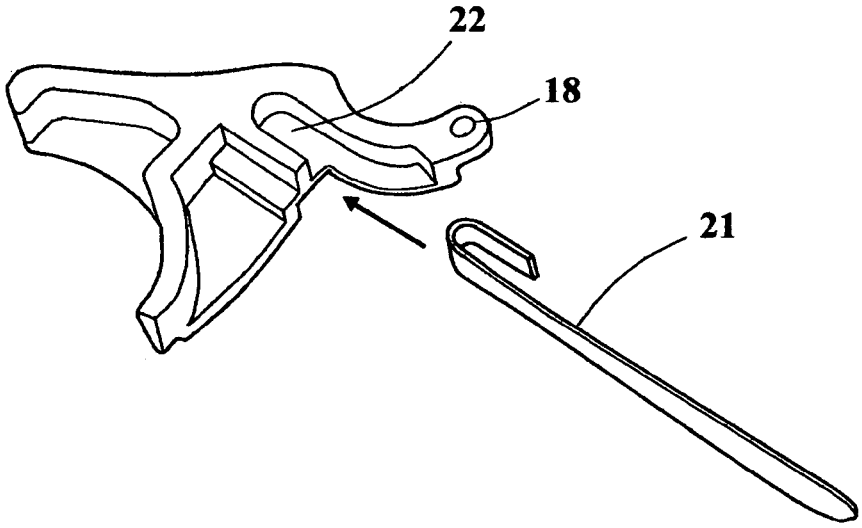
FIG. 4 is a cross sectional view of the push button taken along I-I of FIG. 3 showing the insertion of the plate spring.
Figure 5:
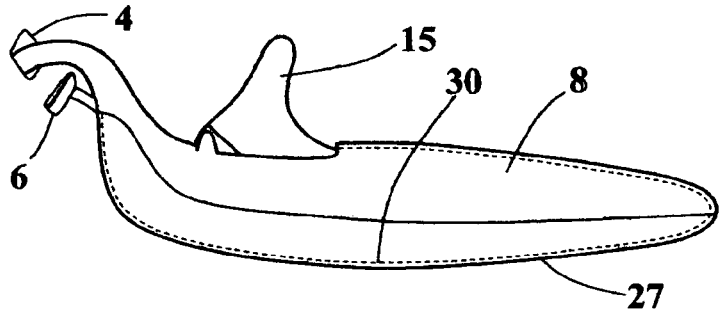
FIG. 5 is a side view of the eyelash curler when the pressurizing member is not pressing at the forming member.
Figure 5A:
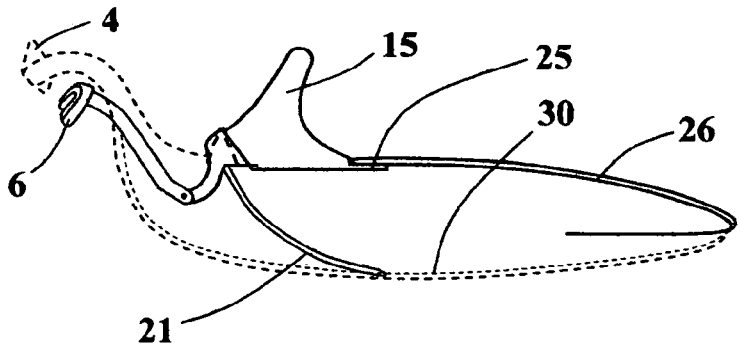
FIG. 5A is a side view of the eyelash curler with part of the head section and lower case shown in phantom showing the relation of the push button with the upper case when the pressurizing member is in a falling position away from the forming member.
Figure 7:
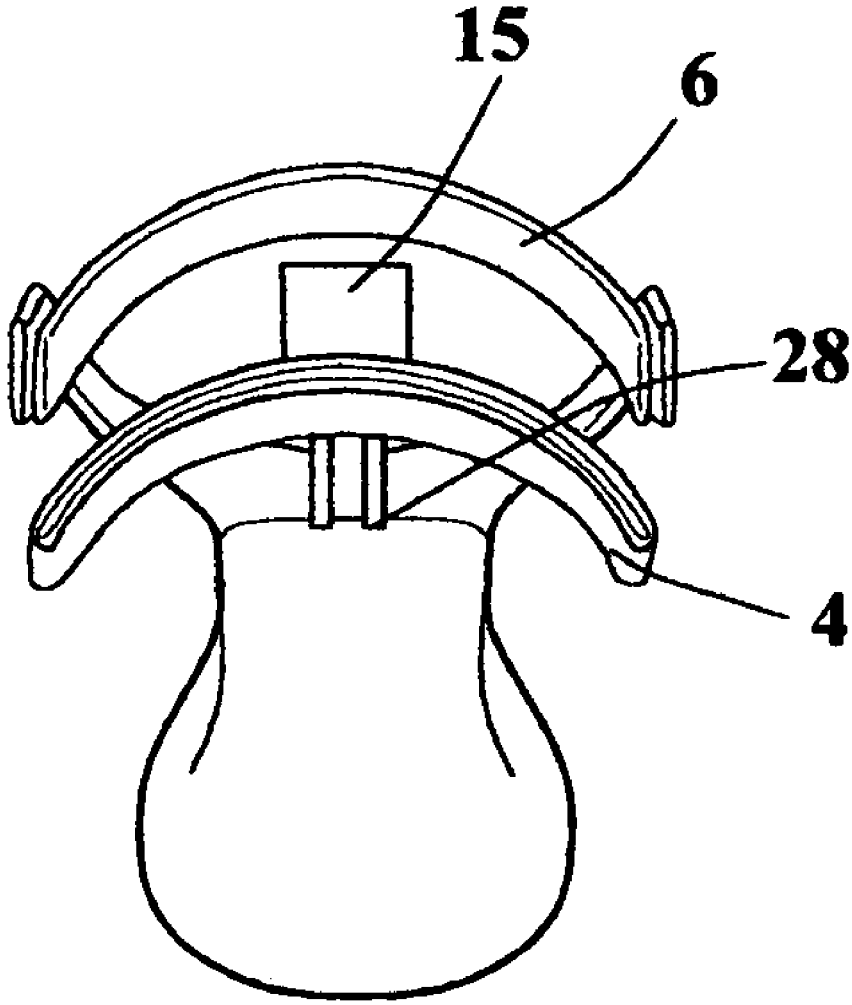
FIG. 7 is a slightly tilted backward top view of the eyelash curler showing the slot or channel where the push button rise and fall.

FIG. 4 shows a cross sectional view of the push button taken along I-I of FIG. 3. The plate spring 21 inserts into a channel 22 etched out from the interior of the push button 15 proximal to the hinge connector 18. FIG. 2 shows the hole 16 at the upper case 8 of the body 2 through which the push button inserts to. After insertion through the hole 16, the push button 15 engages with the upper case by the lodging of a pair of tabs 23 on opposite lateral ends of the push button into a matching pair of connectors 24 protruding at the surface of the upper case 8 of the body 2. The tabs 23 are adjacent to the surface 17 where a finger presses the push button for operation. After the engagement of the tabs 23, as shown in FIG. 5, the peripheral lip 25 of the push button 15 abuts the bottom side 26 of the hole 16 when the push rod is in a falling motion or recess position and the plate spring 21 is in a relaxed position as shown in FIG. 5A. After insertion of the push button and positioning of the push rod, the lower case 27 of the body section 2 connects to the upper 8 case to close the body section of the eyelash curler. The push rod is positioned to situate on a channel 28 at the front end 29 of the upper case 8 which becomes an enclosed slot 28 after the attachment of the lower case 27 to the upper case 8 as shown in FIG. 7. The push rod is free to move up or down, rise or fall, along the slot 28. There are several methods available for connecting the two cases, 8 and 27 together such as by snapping the two cases together through a number of hook like protrusions in combination with matching indentations, by snug fitting pins through cylindrical openings or by snug fitting matching tracks along the periphery of the cases or simply gluing them together.

Figure 6:
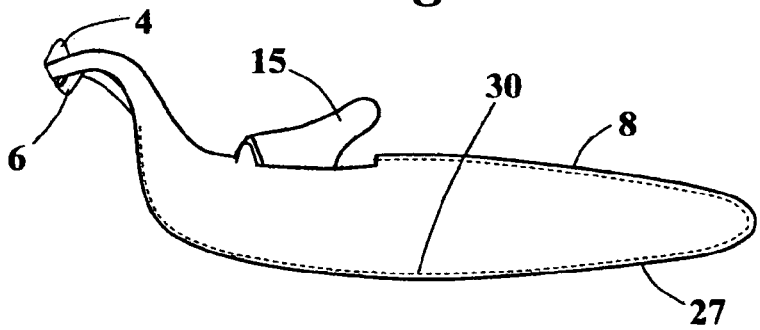
FIG. 6 is a side view of the eyelash curler when the pressurizing member is pressing at the forming member.
Figure 6A:
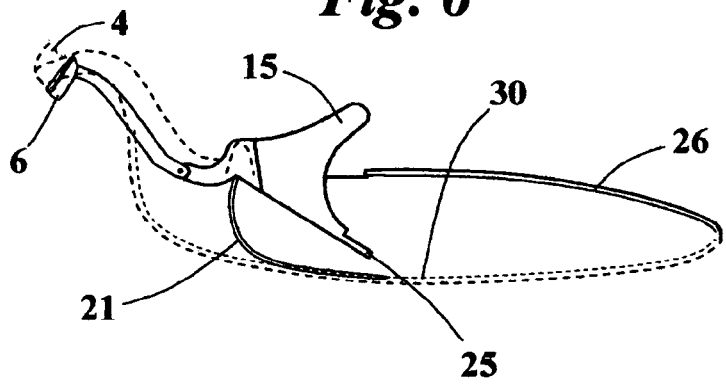
FIG. 6A is a side view of the eyelash curler with part of the head section and lower case shown in phantom showing the relation of the push button with the upper case when the pressurizing member is in a rising position towards the forming member.

To curl the eyelashes, this is placed between the metal blade and the pad at the front side 31 of the curling component and the push button 15 is pushed inwards causing the pressurizing member to rise and sandwich the eyelashes between the pad and the metal blade on the forming member. At this position, the peripheral lip 25 is pushed into the interior of the body section and the plate spring is in a more strained position because the plate spring is made to press against the inner walls 30 of the lower case 27 of the body section as shown in FIG. 6A. After curling, the push button 15 is released causing the push rod or the pressurizing member to recess or move downwards into the interior of the body section or the eyelash curler. At this position, the peripheral lip 25 of the push button 15 again abuts the bottom side 26 of the hole 16 and the plate spring returns to its relaxed position as shown in FIG. 5A.

While the embodiments of the present invention have been described, it should be understood that various changes, adaptations, and modifications may be made therein without departing from the spirit of the invention and the scope of the claims.

I claim:

1. An eyelash curler, comprising:

a head section, the head section including a curling component comprising a stationary forming member and a movable pressurizing member having a pad situated on top of a push rod, the forming member having a curved metal blade conforming to the curvature of the eyelash line with each side of the blade continuously extending to a common continuous strip as a single piece, the common continuous strip of the forming member engaging with a matching receiving base in a superimposing position with the common continuous strip on top of the receiving base, the receiving base located on a forwardly curved extension on the head section of an upper case of a body section, the body section formed from the upper case connecting to a lower case, a lower end of the body section serving as a handle; and, a push button connected to the push rod through a hinge connector comprising a short protruding cylindrical rod with a central through opening at an end of the push button and a pin inserting from one end of the rush rod through the central opening of the protruding cylindrical rod and through an opposite end of the push rod, the protruding cylindrical rod and the pin therethrouah allowing the push button to pivot and situate at a hole on the upper case of the body section having the stationary forming member at a position opposite and facing away from the moving pressuring member at a same location as the lower case of the body section thereby preventing the push button from hitting a face of a user.

2. The eyelash curler of claim 1 wherein a plate spring is inserted into a channel located inside the push button proximal to the hinge connector the plate spring controlling the rise and fall of the push rod as the push button presses on the spring plate.

3. The eyelash curler of claim 1 wherein the pad is a silicone pad shaped to match the metal blade.

4. The eyelash curler of claim 1 wherein the eyelash curler except for the forming member is made of a polymeric material or plastic.

5. The eyelash curler of claim 1 wherein the eyelash curler except for the blade is made of a non-temperature conducting, light but sturdy and durable material.

6. The eyelash curler of claim 1 wherein the forming member slips or snaps on top of the receiving base, held by engagements of matching indentations on the receiving base with protrusions on a strip of the forming member.

7. The eyelash curler of claim 1 wherein the metal blade, the strip and the receiving base are molded together in one unit.

8. The eyelash curler of claim 1 wherein the movable pressurizing member is a curved laterally extending part of the push rod.

9. An eyelash curler, comprising:

a head section including a curling component having a front side and a back side, the front side comprising a stationary forming member and a movable pressurizing member receiving an eyelash between the stationary forming member and the movable pressurizing member for curling;

a body section formed from an upper case connecting to a lower case, a lower end of the body section serving as a handle, the upper case extending and terminating with the stationary forming member opposite the lower end of the body section; and, a rush button connected to the push rod through a hinge connector comprising a short protruding cylindrical rod with a central through opening at an end of the push button and a pin inserting from one end of the push rod through the central opening of the protruding cylindrical rod and through an opposite end of the rush rod. the protruding cylindrical rod and the pin therethrough allowing the push button to pivot and situate at a hole on the upper case of the body section having the stationary forming member at a position opposite and facing away from the moving pressuring member at a same location as the lower case of the body section thereby preventing the rush button from hitting a face of a user.

10. An eyelash curler, comprising:

a head section, the head section including a curling component comprising a stationary forming member and a movable pressurizing member, the forming member having a curved metal blade conforming to the curvature of the eyelash line with each side of the blade extending to a common continuous strip made of a polymeric material or a non-temperature conducting, light but sturdy and durable material and the pressurizing member having a pad situated on top of a push rod;

a body section formed from an upper case connecting to a lower case, a lower end of the body section serving as a handle;

a matching receiving base on a top end or head section of the upper case engaging with the forming member in a superimposing position with the continuous strip on top of the receiving base;

a push button connected to the push rod through a hinge connector comprising a short protruding cylindrical rod with a central through opening at an end of the push button and a pin inserting from one end of the push rod through the central opening of the protruding cylindrical rod and through an opposite end of the push rod, the protruding cylindrical rod and the pin therethrough allowing the push button to pivot and situate at a hole on the upper case of the body section having the stationary forming member at a position opposite and facing away from the moving pressuring member at a same location as the lower case of the body section thereby preventing the push button from hitting a face of a user; and, a plate spring inserted inside the push button, the plate spring pressing against an inner wall of the lower case of the eyelash curler when the push rod of the pressurizing member is raised to engage with the forming member or returning to a relaxed position when the push rod is recessed to disengage with the forming member.

11. The eyelash curler of claim 10 wherein both the metal blade and the pad are curved to conform with an eyelash line.

12. The eyelash curler of claim 10 wherein the pad is a silicone.

13. The eyelash curler of claim 10 wherein the polymeric material is plastic.

14. The eyelash curler of claim 10 wherein the eyelash curler except for the metal blade on the forming member is made of a polymeric material or a non-temperature conducting, light but sturdy and durable material.

15. The eyelash curler of claim 10 wherein the push button raises the push rod as the push button press the plate spring against the inner wall of the lower case of the body section.

16. The eyelash curler of claim 10 wherein the plate spring is inserted into an etched out channel located inside the push button proximal to the hinge connector connecting the push button with the push rod through the pin, the plate spring controlling the rise and fall of the push rod as the push button presses on the spring plate.

17. The eyelash curler of claim 10 wherein the metal blade, the strip and the receiving base are molded together in one unit.

18. The eyelash curler of claim 10 wherein the forming member slips or snaps on top of the receiving base, held by engagements of matching indentations on the receiving base with protrusions on the strip of the forming member.

19. The eyelash curler of claim 10 wherein the push button situates on an enclosed slot at a front end of the upper case after attachment of the lower case to the upper case allowing the push rod to move up or down along the enclosed slot.

* * * * *